US012539943B2

(12) United States Patent
Cavanagh, Jr.

(10) Patent No.: US 12,539,943 B2
(45) Date of Patent: Feb. 3, 2026

(54) GRAVITY BUOY

(71) Applicant: Robert J. Cavanagh, Jr., Lincoln, RI (US)

(72) Inventor: Robert J. Cavanagh, Jr., Lincoln, RI (US)

( * ) Notice: Subject to any disclaimer, the term of this patent is extended or adjusted under 35 U.S.C. 154(b) by 505 days.

(21) Appl. No.: 18/159,843

(22) Filed: Jan. 26, 2023

(65) Prior Publication Data

US 2023/0234675 A1 Jul. 27, 2023

Related U.S. Application Data

(60) Provisional application No. 63/303,557, filed on Jan. 27, 2022.

(51) Int. Cl.

| | |
|---|---|
| ***B63B 22/20*** | (2006.01) |
| ***B63B 22/04*** | (2006.01) |
| ***B63B 22/18*** | (2006.01) |

(52) U.S. Cl.

CPC ..... *B63B 22/20* (2013.01); *B63B 22/04* (2013.01); *B63B 22/18* (2013.01)

(58) Field of Classification Search

CPC ..... B63B 22/00; B63B 22/04; B63B 22/20; B63B 22/18; B63B 21/00; B63B 21/52

USPC ..... 441/23, 26

See application file for complete search history.

(56) References Cited

U.S. PATENT DOCUMENTS

| | | | | |
|---|---|---|---|---|
| 2,790,186 | A | 4/1957 | Carapellotti | |
| 3,775,787 | A | 12/1973 | Rager | |
| 4,649,663 | A * | 3/1987 | Strickland | A01K 95/00 43/44.9 |
| 7,699,676 | B2 | 4/2010 | Nicholson | |
| 7,997,223 | B2 | 8/2011 | Bailey | |
| 8,485,855 | B1 | 7/2013 | Vogel | |
| 2009/0211240 | A1 | 8/2009 | Patton | |

(Continued)

FOREIGN PATENT DOCUMENTS

| | | | |
|---|---|---|---|
| CN | 102303687 | A | 1/2012 |
| CN | 202508262 | U | 10/2012 |
| DE | 202005016106 | U1 | 5/2006 |

(Continued)

OTHER PUBLICATIONS

"Self-Leveling Buoy System Design: Design Feedback Please." (Accessed Jan. 15, 2021) https://www.ballofspray.com/forum#/discussion/23301/self-leveling-buoy-system-design-design-feedback-please.

*Primary Examiner* — Lars A Olson

(74) *Attorney, Agent, or Firm* — Hinckley, Allen & Snyder, LLP; David R. Josephs

(57) ABSTRACT

The gravity buoy includes a can float that is visible above the waterline and provides the buoyancy for the device. A pulley assembly permits a tether under constant tension to pass easily through a point near the bottom of the can float, thus creating a pull point. A tension weight provides the downward force that puts the tether under constant tension so that the can float maintains its location above the anchor, and helps keep the can float vertical in the water along with concrete ballast inside the bottom of the can float. An anchor provides the downward force that will keep the buoyancy of the can buoy and the weight of the tension weight from displacing the gravity buoy from its intended location. An inline weight provides downward force on the anchor-side of the tether.

9 Claims, 13 Drawing Sheets

(56) References Cited

U.S. PATENT DOCUMENTS

| | | | |
|---|---|---|---|
| 2011/0018275 | A1 | 1/2011 | Sidenmark |
| 2018/0073482 | A1 | 3/2018 | Sheldon-Coulson et al. |

FOREIGN PATENT DOCUMENTS

| | | | |
|---|---|---|---|
| KR | 20120126506 | A | 11/2012 |
| WO | 2015039483 | A1 | 3/2015 |

* cited by examiner

GRAVITY BUOY

CROSS REFERENCE TO RELATED APPLICATION

This patent document claims priority to earlier filed U.S. Provisional Patent Application Ser. No. 63/303,557, filed Jan. 27, 2022, the entire contents of which are incorporated herein by reference.

BACKGROUND OF THE INVENTION

The invention related generally to navigation aids for watercraft.

There is a known problem in the boating industry in that inland waterways, harbors, and marinas are often located in areas that require boaters to navigate in limited spaces, shallow waters, and in close proximity to the shore, rocks, sandbars, and other submerged obstacles that present a risk to safety and of damage to boats. Orderly management of large volumes of boat traffic in such bodies of water also requires clearly marked channels and passages. It is, therefore, particularly important to mark such submerged obstacles and passages accurately with buoys. Traditional buoys have limited utility for this purpose because they are tethered to anchors using single-length tethers and chains. Such tethers are usually installed so that they are long enough to accommodate the mean higher high tide at a given location so that the weight of the anchor does not cause the buoy to submerge and become invisible as the water rises to its upper limit, or alternatively cause the buoyancy of the buoy to uproot the anchor and cause it to move. An unfortunate consequence of this tolerance is that single-length tethers on such buoys become slack and tend to allow the buoy to drift significantly at all times except during the highest tides. Thus, a buoy's accuracy is negatively affected by lowering tides, and still further by wind, currents, and the wakes of passing boats. The irony of the problem is that the accuracy of such buoys decreases as the tide lowers while, on the other hand, the need for accuracy is simultaneously increasing due to increased probability of a collision with a submerged obstacle due to shallower depths surrounding such obstacles.

There are no known effective solutions to the problems above. There have been attempts in the prior art to provide a fixed rod secured to the seafloor on which a buoyant tube slides up and down with the water level, but the rigidity of the fixed rod leaves it prone to shock and damage by wave action or collision with boats. Other prior buoys have been known to sit at the same depth but had a similar buoyant tube that slid up and down with the tide, but have limited ability to function in locations with large great diurnal ranges or shallow depths.

Attempted solutions by prior art have failed to address the needs of the industry. In view of the foregoing, there is a demand for a buoy that can accurately mark its location regardless of the water depth or tide. There is also a need for a such a buoy to be easy to install and maintain.

SUMMARY OF THE INVENTION

The present invention preserves the advantages of prior art buoys. In addition, it provides new advantages not found in currently available buoys and overcomes many disadvantages of such currently available buoys.

The invention is generally directed to the novel and unique gravity buoy. The present invention addresses the above-mentioned problems in the boating industry. The gravity buoy of the present invention maintains a position over the anchor to which it is tethered no matter the tide, wind, current, or wave action from passing boats. The buoy will incorporate a system that uses a weight on the end of a tether that travels through a pulley and then down to an anchor to create a constant tension on the tether, thus keeping the buoy at the shortest possible distance from the anchor, i.e., directly above it. All component parts of the buoy are made of high-density polyethylene ("HDPE"), except the tether. Therefore, the raw materials are inexpensive to purchase, easily machined and welded together, and are recyclable.

It is, therefore, an object of the present invention to provide a gravity buoy that provides markings for channels and submerged obstacles with enhanced accuracy for safe marine navigation in inland and close-to-shore waterways. The gravity buoy should be a far less expensive option for cities, towns, and privately-run harbors and marinas than current marker buoys offered for sale by the leading buoy manufacturers, especially because it will require less ballast weight. Since the gravity buoy will be made of HDPE, it will also be 100% recyclable. HDPE is often used for food containers and medical devices because it is an inert plastic and so will not leach harmful chemicals into the environment. HDPE's natural resistance to marine fouling also means that the gravity buoy will not require antifouling paint that often releases harmful chemicals into water and would increase the cost of production and maintenance. HDPE is also self-lubricating so that the moving parts thereof will not require additional lubrication using harmful chemicals and increased cost. While the use of HDPE, among other plastics, is not a new concept in the production of buoys, the manufacture of a gravity buoy together with its functional components entirely from HDPE is new and novel and an advance over known buoys.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

DESCRIPTION OF THE INVENTION

As shown in the attached figures, the gravity buoy of the present invention includes several components.

Figure 1:
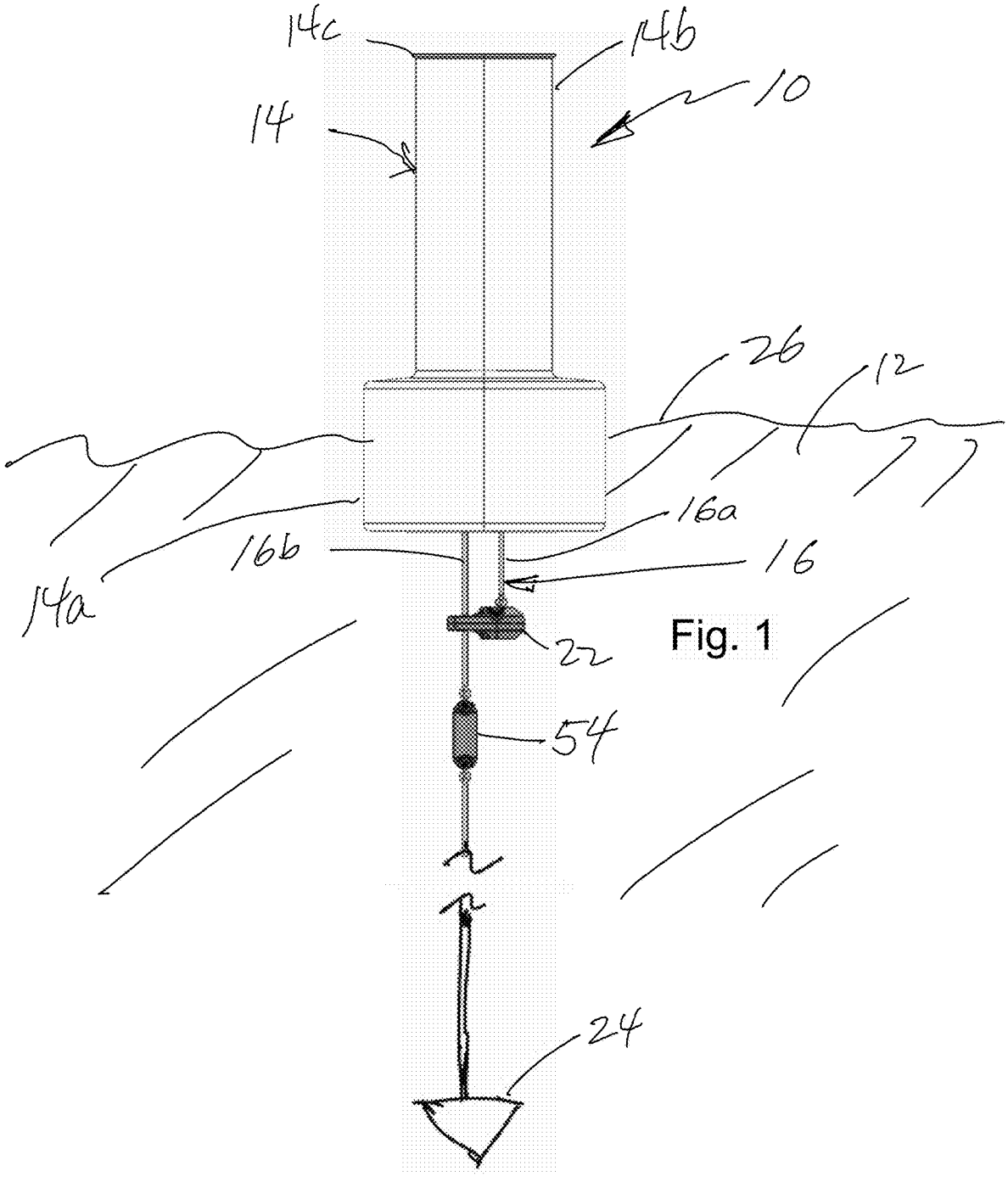
FIG. 1 is a front view of the gravity buoy of the present invention fully assembled.
Figure 2:
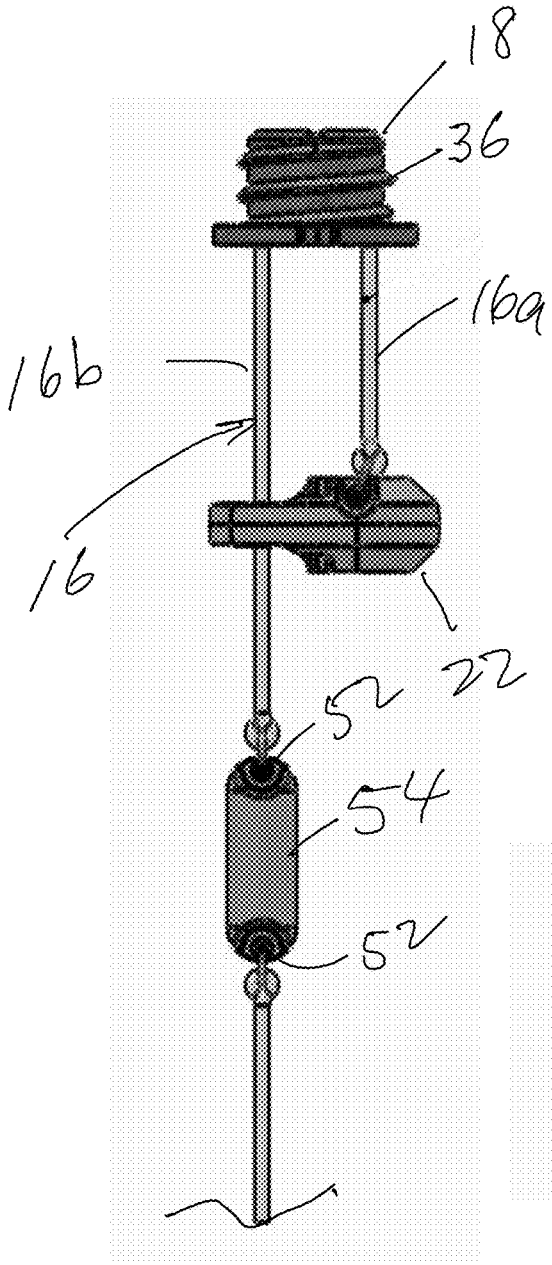
FIG. 2 is a front view of the plug, tension weight and connector members removed from the can float.
Figure 3A:
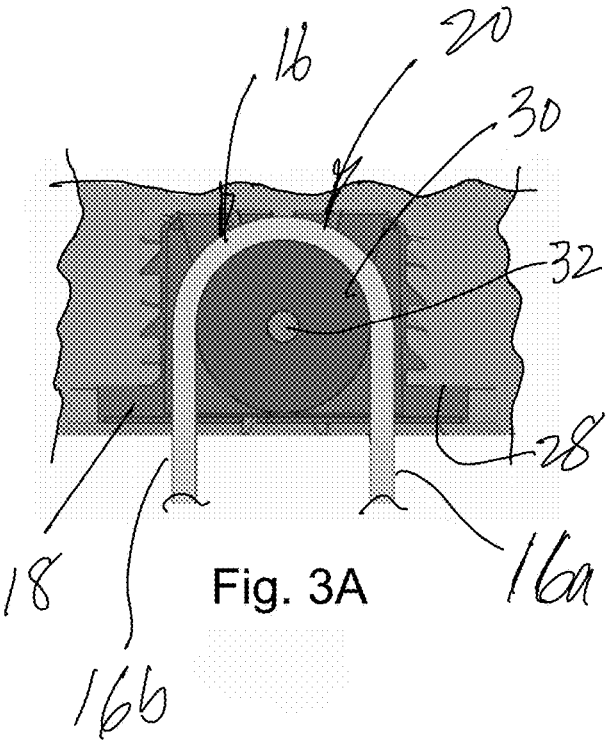
FIG. 3A is a partial cross-sectional view of through the line 3A-3A of FIG. 8B.
Figure 3B:
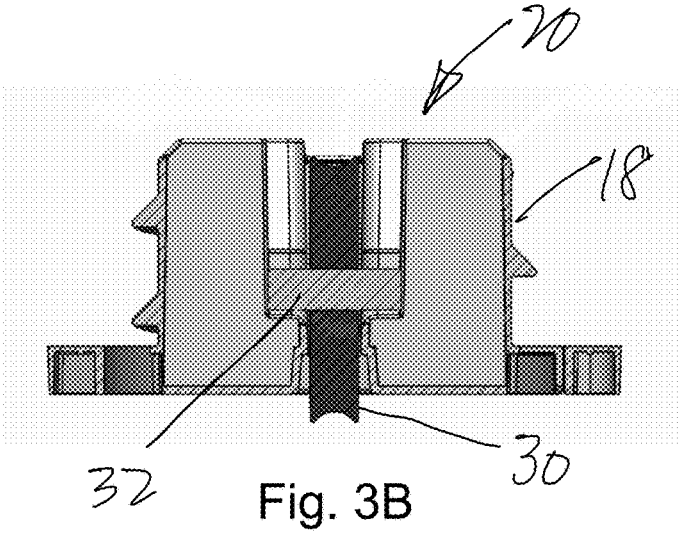
FIG. 3B is a partial cross-sectional view of through the line 3B-3B of FIG. 8B.
Figure 12:
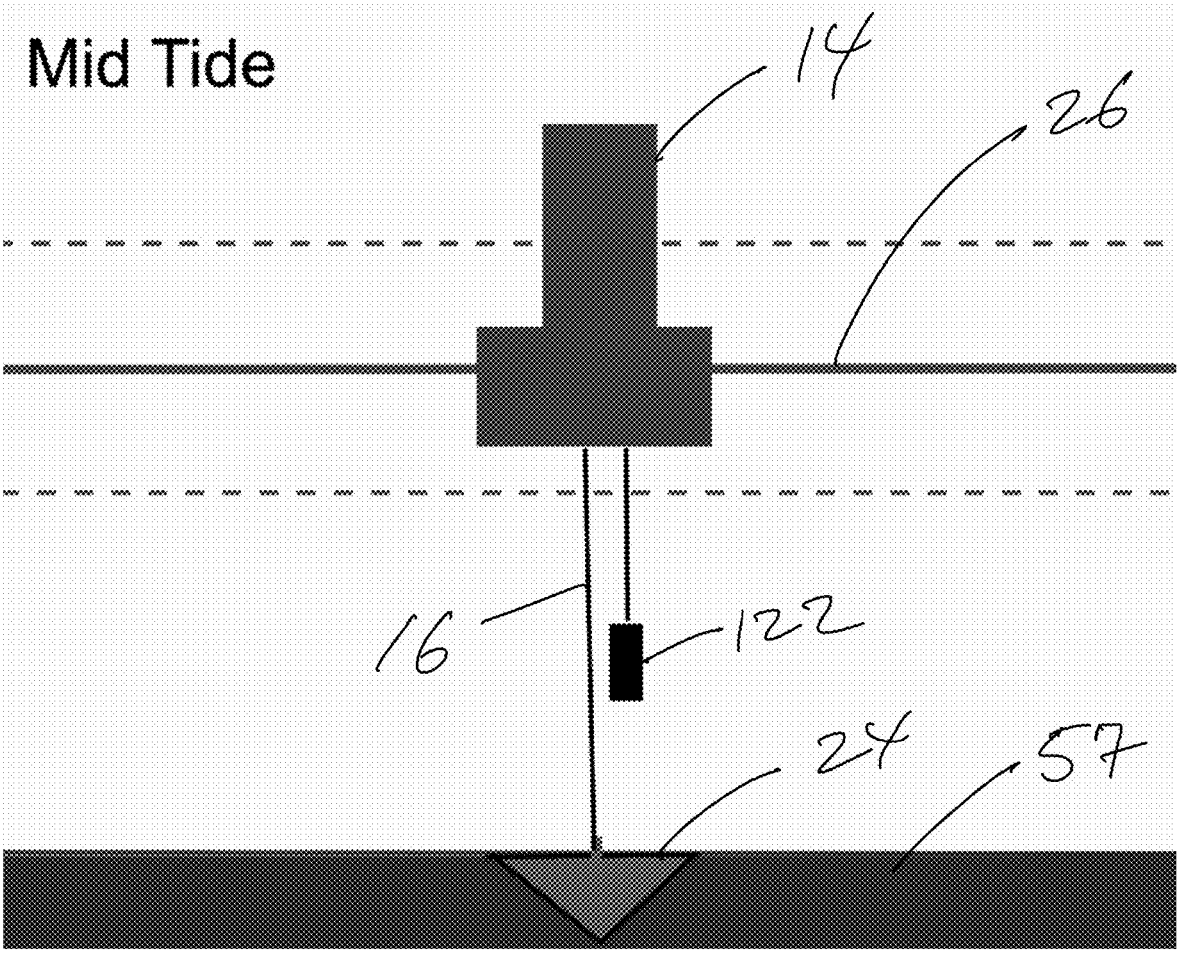
FIG. 12 shows the invention in use during mid tide using a non-passthrough tension weight.

The gravity buoy 10 of the present invention, fully assembled and in place in water 12, is shown in FIG. 1. The gravity buoy 10 includes a float 14, such as in the configuration of a "can" type float. However, the float 14 may be of any other type of overall configuration to suit the environment at hand or comply with applicable government regulations. As can be seen in FIGS. 2, 3A, 3B, a tether 16 has a first end/side 16*a* and a second end 16*b* that is optionally routed through the float 14 as in FIG. 1, via a plug 18 with a pulley assembly 20, with the first end 16*a* connected to a tension weight 22 that acts as a counterbalance, while the opposing second end 16*b* of the tether 16 is connected to an anchor 24 with an inline weight 54 preferably disposed therebetween. The inline weight 54 is unnecessary in locations where the great diurnal range is less than the depth at median lower low tide, as in FIGS. 12-14, because, in such locations, the tether 16 can be of a length such that the tension weight 22 does not come in contact with the top surface of the anchor 24 at the mudline 57 before slack tide, as in FIGS. 15-16. Details of each of the components of the gravity buoy 10 are discussed in detail below.

The tension weight connected to the tether can be of different configurations. Alternatively, as in FIGS. 12-17, the tension weight 22 may be a tethered tension weight 122 that is attached to end 16*a* of the tether 16 where there is no interaction with the second end 16*b* of tether 16. In other words, the second side 16*b* of the tether 16 does not pass through the tension weight 122 in the alternative configuration of FIGS. 12-17 to provide for a simpler configuration which may be more suitable in certain situations and environments compared to the tension weight 22 of FIG. 1

The float 14 is shown in detail in FIGS. 4-8. The float 14 is mostly visible and above the waterline 26, and provides the buoyancy for the gravity buoy 10. It is preferably made of a watertight, buoyant cylinder made entirely of high-density polyethylene (HDPE), which is preferably a roto-molded body. Inside the float 14, the bottom will be partially filled with self-leveling concrete to help ensure self-leveling in the water, while the rest of the inside of the float 14 will be hollow or filled with closed cell foam to ensure rigidity and buoyancy in case of puncture. The amount of concrete in the inside the bottom of the float 14, and so also the amount of hollow or foam-filled space therein, will depend on conditions. The float 14 is preferably cylindrical in shape and can be of any dimension and size but is preferably 32.0 inches high, 16.0 inches in diameter at its base portion 14*a*, and 9.0 inches in diameter at its top portion 14*b*. The radius of the very top of the float 10, at its top ridge 14*c*, is preferably 9.5 inches to assist with lifting it out of the water for removal or maintenance. It should be understood that certain water environments may require the float 14 to be configured in different dimensions and size depending on the nature of the water environment, water temperature, tide patterns and turbulence of the water.

Figure 4:
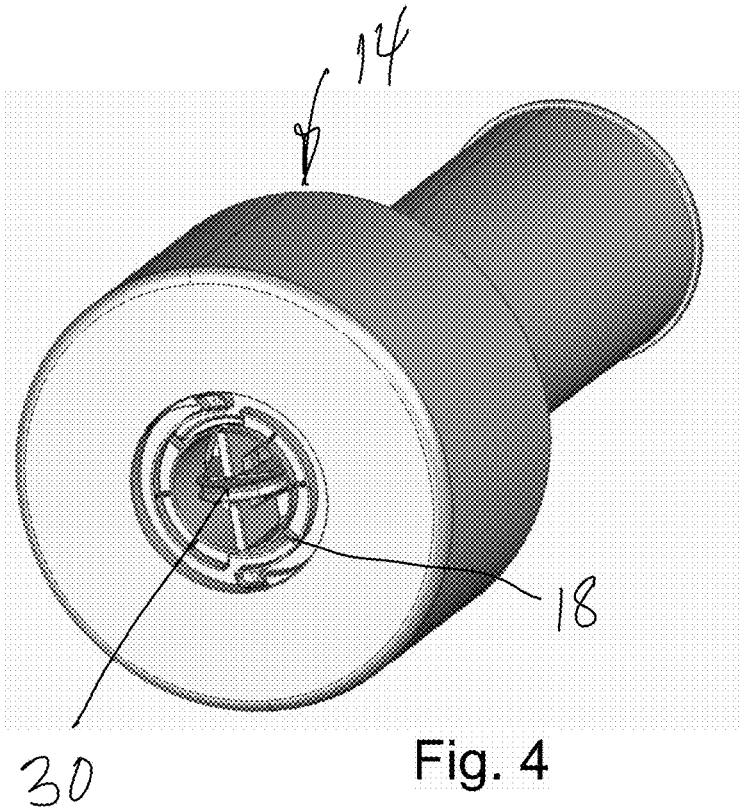
FIG. 4 is a bottom perspective view of the plug assembly located in the bottom of the can float.
Figure 5:
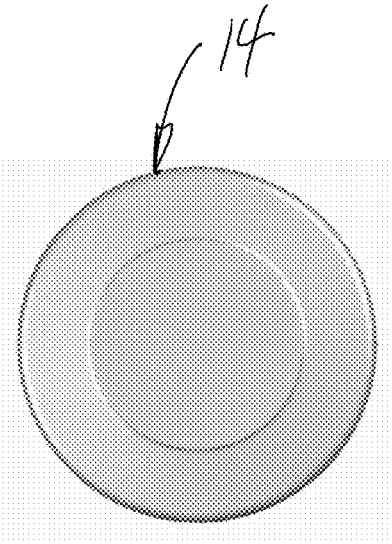
FIG. 5 is a top view of the can float.
Figure 6:
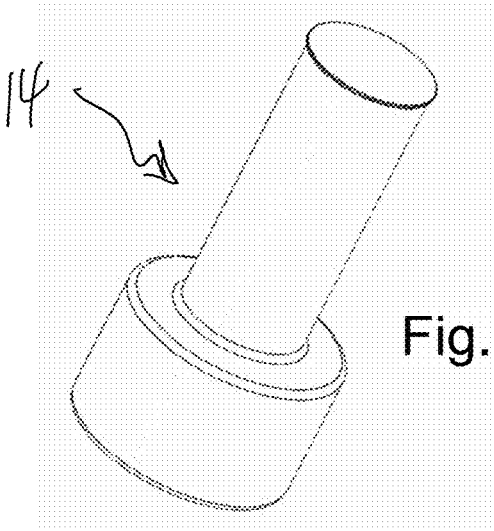
FIG. 6 is a front perspective view of the can float.
Figure 7:
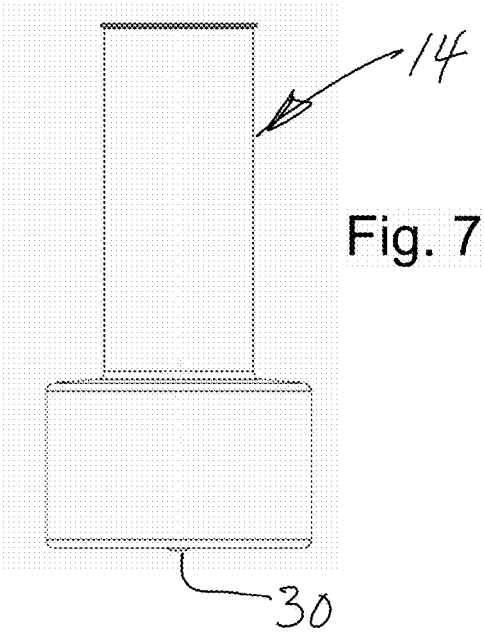
FIG. 7 is a front elevational view of the can float.
Figures 8A, 8B:
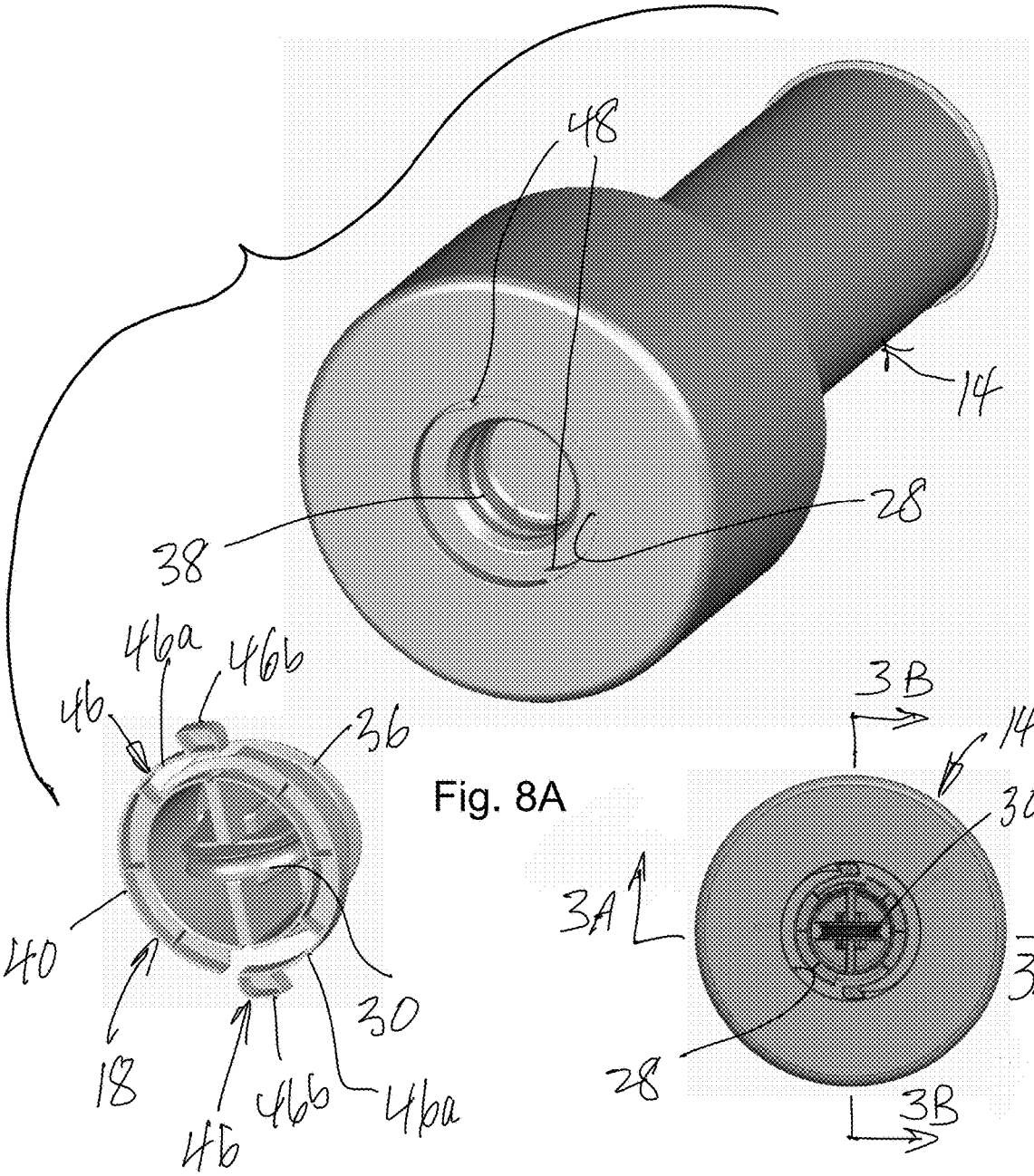
FIG. 8A is an exploded bottom perspective view of the can float and plug assembly.
FIG. 8B is a bottom view of the can float and plug in assembled form.

FIG. 8A shows a bottom perspective of the float 14 with a seat 28 in the bottom surface thereof which receives the plug member 18 with an integrated pulley assembly 20 that includes a wheel 30 and shaft 32. FIG. 4 shows a bottom perspective of the float 14 with the plug 18 inserted into the seat 28. FIG. 8A shows an exploded view of the plug 18 and float 14 assembly in accordance with the present invention. The plug 18 with pulley assembly 20 is incorporated into the bottom of the can float 14, as shown in further detail in FIGS. 9A-D. The pulley assembly 20 permits the tether 16 to be under constant tension to pass easily through a point near the bottom of the float 14, thus creating a pullpoint at a location that keep the can float 14 located above the anchor and helps keep it vertical in the water 12.

The plug 18 is rotationally mounted, preferably threadably mounted, in the bottom of the float 14, as seen in FIGS. 9A-D preferably using a recessed plug-like construction to retain the pulley assembly 20 in place. In general, the plug 18 preferably includes male threading 36 to threadably engage with a female threaded receiving seat 38 in the bottom of the float 14. It is also possible to provide a snap-in or push in interconnection of the plug 18 and the bottom of the float 14.

Figure 9A:
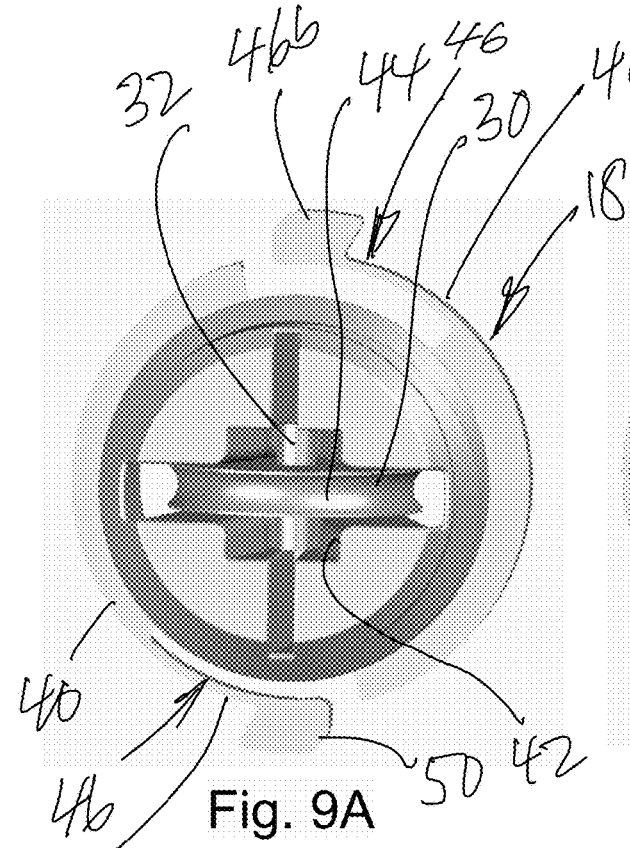
FIG. 9A is a top perspective view of the plug assembly.
Figure 9B:
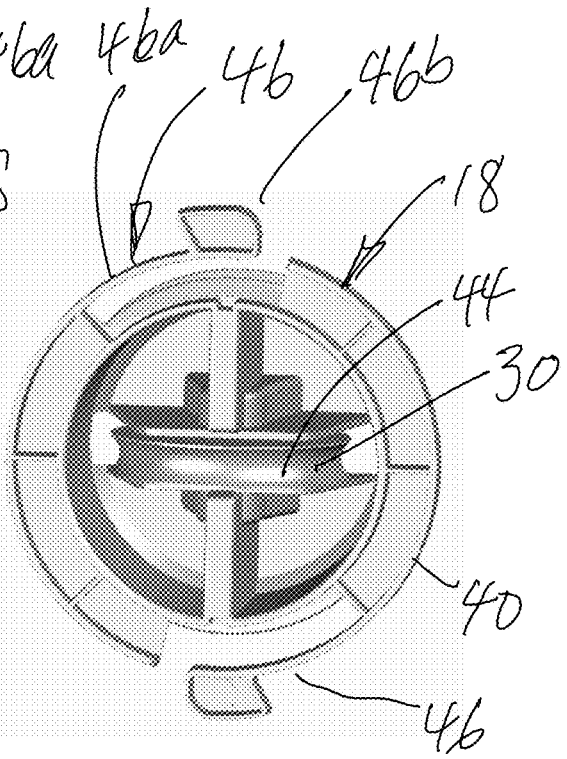
FIG. 9B is a bottom perspective view of the plug assembly.
Figure 9C:
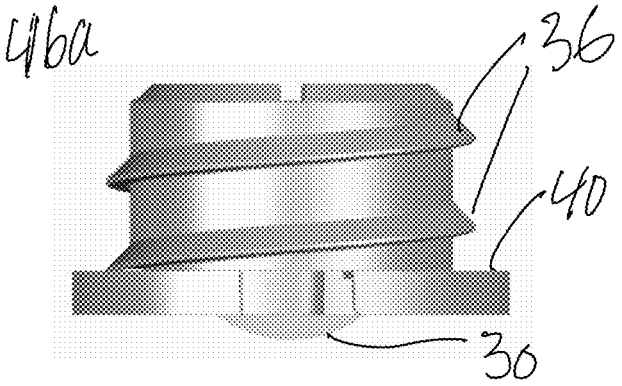
FIG. 9C is a front elevational view of the plug assembly.
Figure 9D:
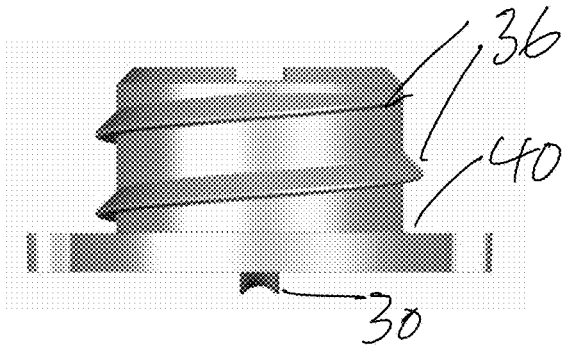
FIG. 9D is a side elevational view of the plug assembly.
Figure 10A:
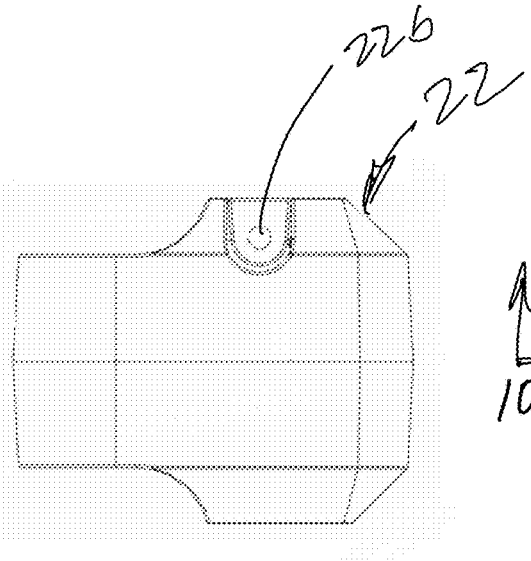
FIG. 10A is a front elevational view of the buoy tension weight.
Figure 10B:
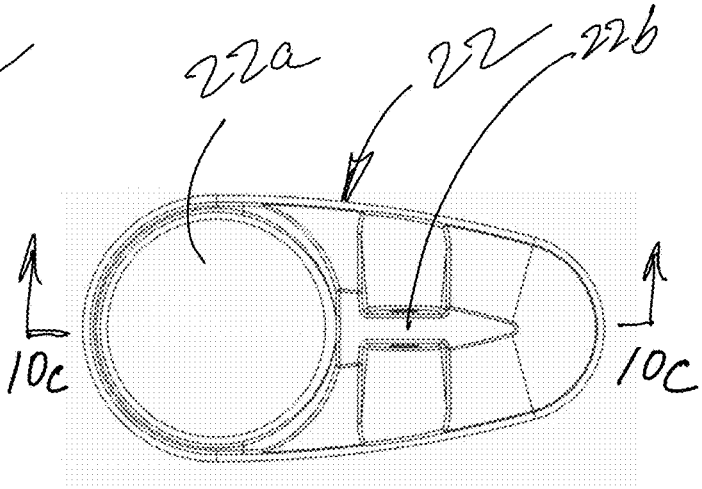
FIG. 10B is a top view of the buoy tension weight.
Figure 10C:
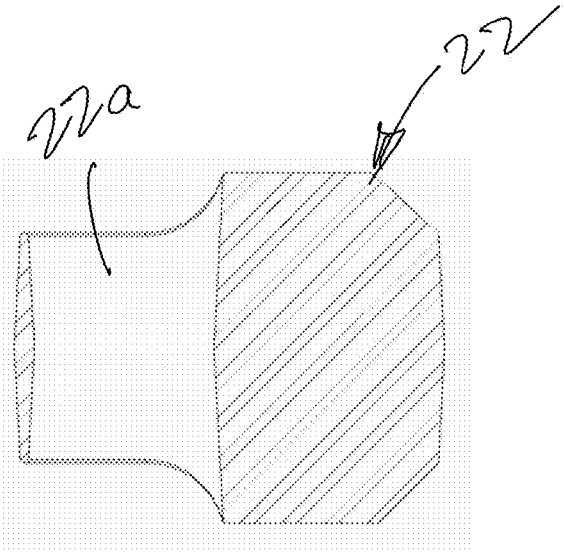
FIG. 10C is a cross-sectional view through the line 10C-10C of FIG. 10B.
Figure 10D:
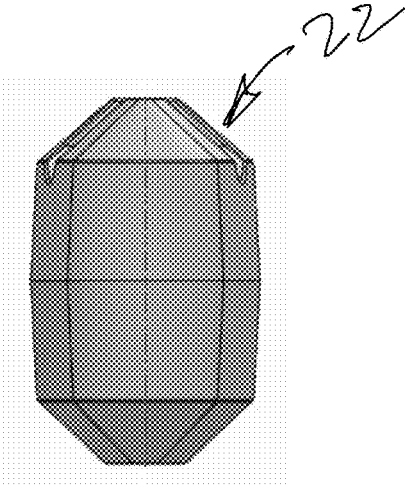
FIG. 10D is a right side elevational view of the buoy tension weight.
Figure 11A:
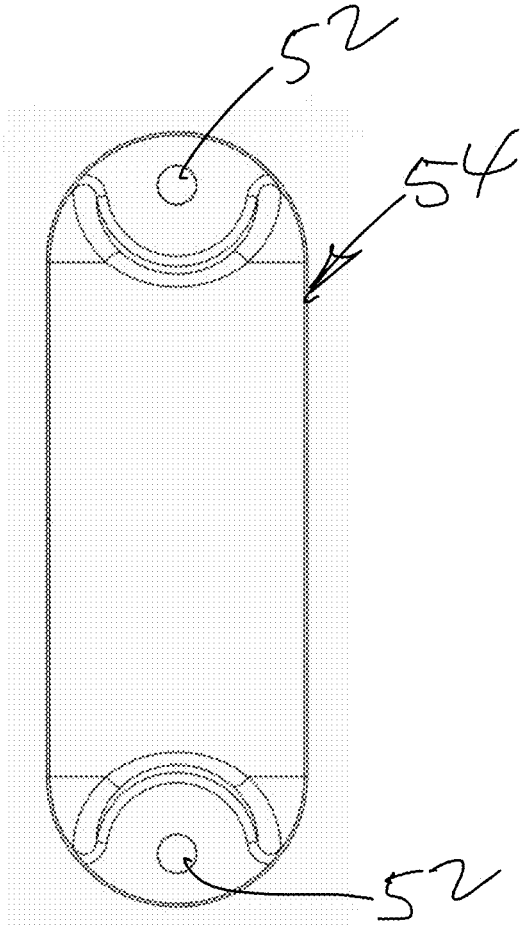
FIG. 11A is top view of the in-line weight/connector.
Figure 11B:
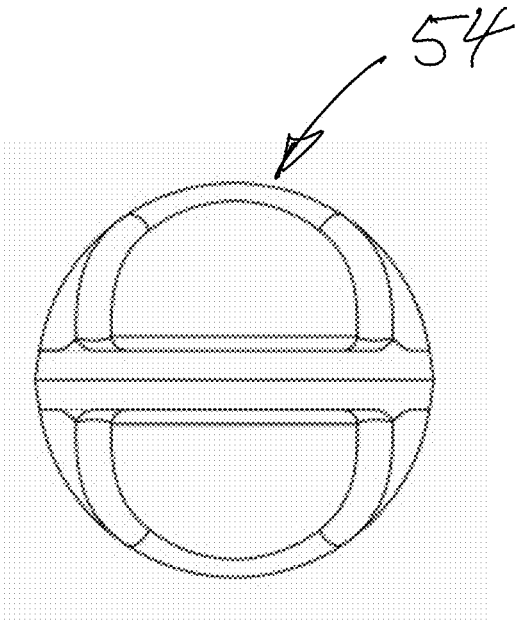
FIG. 11B is a side elevational view of the in-line weight/connector.

The plug 18 has an outer housing 40 with the male threading 36 on the outside thereof. The housing defines a recess 42, namely, a slot to receive a shaft pin 32 onto which the pulley wheel 30 is mounted, as seen in the top view of the plug seen in FIG. 9A. The bottom view of the plug 18, seen FIG. 9B, shows the pulley wheel 30 mounted and secured in place so when the plug 18 is secured in place in the bottom of the float 14, a portion of the pulley wheel 30 can be seen in FIGS. 9C and 9D. The plug 18 may be 3.125 inches high and 5.88 inches across. The pulley wheel 30 may have a diameter of 3.25 inches and a width of 0.625 inches with a tether groove 44 having a radius of RO.3125 inches. The wheel axle/shaft 32 is preferably 1.625 inches long with a diameter of 0.50 inches.

Thus, the threading 36 provided on the outside of the plug 18 and inside of the bottom opening at 38 of the float 14 is so that when the plug 18 is threaded therein, it is secured in place. This greatly facilitates and speeds up the integration of the plug assembly 18 into the float 14. As can be seen in FIGS. 9A, 9B and 8, the plug 18 includes spring-biased snap flange arms 46 to prevent the plug 18 from unwanted backing out. There are preferably two flange arms 46 but there may be more or less than two arms. Each arm 46 has a flexible portion 46*a* and an engagement free end 46*b* that engages with ramped shoulders 48 in the bottom open seat 28 of the float 14. As can be understood, when the plug 18 is threaded into the bottom seat 28 of the float 14, the engagement ends 46*b* of spring-biased flange arms 46 ride over the ramped shoulders 48 on the float 14 when the plug 18 is screwed in a clockwise direction. Once the plug 18 is threaded enough where the engagement ends 46*b* pass by the shoulders 48, the spring biasing of the arms 46 will cause the engagement ends 46*b* to snap out and extend radially behind the shoulders 48, as can be seen in FIG. 4. Once the plug 18 is threaded and locked in place, the plug 18 will be prevented from being unscrewed in the counterclockwise direction, first by the tightness of the interaction between the male threading 36 and the female threading 38, and then by the contact between the engagement ends 46*b* and the shoulders 48. If removal of the plug 18 is needed or desired, the plug can be unscrewed and the free engagement ends 46*b* can be squeezed or pulled toward each other so they can clear past the shoulders 48 on the float 14 so the entire plug 18 can be freely unscrewed for full removal.

Referring back to FIGS. 1-3, details are shown of the tension weight 22 and how it provides the downward force that puts the tether 16 under constant tension and how it is routed through the installed plug 18 in the bottom of the float 14. The first embodiment of the tension weight 22 of FIGS. 10A-D includes the tension weight 22. The tension weight 22 is offset from center to accommodate the tether 16 and cylindrical inline weight 54, as seen in FIGS. 1 and 2. The tension weight 22 is configured and balanced and is of weight to pull the can float 14 into a position above the anchor 24 in spite of wind, waves, current, and tidal changes, and to provide ballast in order to minimize the effect of changes in vertical forces of gravity and buoyancy on the tether 16 and anchor 24 due to wave action. The tension weight 22 may have a weight sufficient to provide effective ballast for the float 14 such that the installation of ballast weight inside the float 14 is unnecessary, depending on conditions. On the opposite side of tension weight 22, an enclosed vertical passthrough 22*a* is provided to permit the tether 16 and inline weight 54 to pass therethrough and connect to an anchor 24, as representationally shown in FIG. 1. The pulley assembly 20 rotates as the tension weight 22 itself moves up and down in the water column 12 as the buoyant force of the float 14 pulls the pulley assembly 20 up and down with the tide, for example. On the top of the tension weight 22 is a pass-through eye 22*b* so it can be connected to the tether 16.

The tension weight 22 can be 4.375 inches high, 5.375 inches long with a 2.25 inch diameter hole 22*a* therein. The tension weight can be 5-6 pounds but can be modified to suit the water environment at hand.

Alternatively, it is also possible that a simple counterbalance weight 122 of FIGS. 12-17 can be used instead of the tension weight 22 of FIGS. 10A-D and FIG. 1. For example, the tension weight 122 may be of a cylindrical configuration or other shape and actuate up and down in parallel with the tether 16 without the tether 16 being routed therethrough as in FIGS. 1 and 2. The tether 16 is mounted or connected to the top of the cylinder weight 122 using a tether 16 connection, such as an eye, shackle or the like. The non-passthrough cylinder tension weight 122 can be 5-6 pounds but can be modified to suit the water environment at hand.

The gravity buoy 10 of the present invention also includes an anchor 24 that provides the downward force that will keep the buoyancy of the float 14 and the weight of the tension weight 22, 122 from displacing the gravity buoy 10 from its intended location. The anchor 24 is representationally shown in FIGS. 1 and 12-16. The anchor 24 can be a roughly conical or pyramidal mass of steel or concrete with a shaft or loop on the topside thereof to which the tether 16 is secured, as in FIGS. 12-16. The anchor 24 has significantly greater mass than the tension weight 22, 122 in order to prevent the forces imparted on the tether 16 by the tension weight 22, 122 and the float 14 from dislodging the anchor 24.

As above in connection with FIGS. 10A-D and FIGS. 12-17, the tether 16 connects the anchor 24 to the tension weight 22, 122 (through the passthrough aperture 22*a* in the tension weight 22 of the configuration of FIGS. 10A-D). The tether 16 allows the gravitational and buoyancy forces to be balanced. It is preferably made of double braid nylon rope or, depending on testing, stainless steel cable which may be coated or uncoated. It is spliced around a thimble and secured to the top the anchor 24 at one end, passes up from the anchor 24 through the pulley assembly 20 on the bottom of the float 14, and then returns downward to where it is spliced around a thimble at the other end and secured to the top of the tension weight 22 or 122, whether the tension weight 22 has a tether pass-through 22*a* of FIGS. 1, 10A-D or whether the tension weight 122 does not have a tether pass-through, as in FIGS. 12-17.

An inline weight 54, as shown in FIGS. 1, 2, 11A-B, 15 and 16, provides downward force from the anchor-side of the tether 16 when the tension weight 22, 122 drops into contact with the top surface of the anchor 24 at the mudline 57 due to lowering tide. The inline weight 54 is necessary in locations where the great diurnal range is greater than the depth at median lower low tide.

When the tide lowers the float 14 to the point where the tension weight 22, 122 comes to rest on the top of the anchor 24, the tension weight 22, 122 itself can no longer create tension on the tether 16. The inline weight 54 is only necessary when a gravity buoy 10 is anchored in a location where the great diurnal range is greater than the depth of the mean lower low tide, as in FIGS. 15 and 16, because, in such locations, the tether must be long enough to accommodate a high tide but will be so long as to allow the tension weight 22, 122 to come in contact with the top surface of the anchor 24 at the mudline 57 before slack tide as the tide and waterline 26 lowers. As in FIG. 11A, the inline weight 54 is preferably of a capsule-shape with passthrough eyes 52 at both ends to permit attachment of sections of the tether 16. The inline weight 54 could be, for example, 6.02 inches long and 2.02 inches wide with eyes having a diameter opening of 0.30 inches. The thickness of the inline weight 54 at the free ends of the inline weight 54 are preferably 0.30 inches thick.

The use of an inline weight 54 is shown in FIGS. 1, 2, 15, and 16. The inline weight 54 weighs sufficiently less than the tension weight 22, 122 as so to allow the tension weight 22 to always create tension on the tether 16 when the tension weight 22 is suspended in the water 12, but may weight 3-4 pounds in order to create sufficient tension on the tether 16 so as to keep the float 14 in its intended location above the anchor 24 when the tension weight 22, 122 has come to rest at the mudline 57. It is installed between the anchor 24 and the bottom of the float 14 on the second side 16*b* of the tether 16 opposite from the tension weight 22, 122. The appropriate size and weight can be customized to suit the particular water environment at hand to achieve best performance.

Referring now to FIGS. 12-16, the operation use of the gravity buoy 10 of the present invention is shown in different water situations to illustrate the unique capabilities of the present invention. In use, the gravity buoy 10 also functions in locations where the great diurnal range is less than the depth of the mean lower low tide as described in detail below.

Therefore, the three components create forces on the tether 16 at all times: (1) the anchor 24 transmits the force of gravity pulling downwards on the tether 16 between the anchor 24 and the pulley assembly 20 located on the bottom of the float 14; (2) the float 14 transmits a buoyant force pulling upwards on the tether 16 between the pulley assembly 20 and the anchor 24, and between the pulley assembly 20 and the tension weight 22, 122; and (3) the tension weight 22, 122 transmits the force of gravity pulling downwards on the tether 16 between the tension weight 22, 122 and the pulley assembly 20. All other forces being equal, these three forces are reasonably constant and their sum results in an equilibrium such that the distance between the float 14 and the anchor 24 is constant at a given moment in time, as shown representationally in FIG. 12 thereby illustrating the unique functional ability of the present invention.

Figure 13:
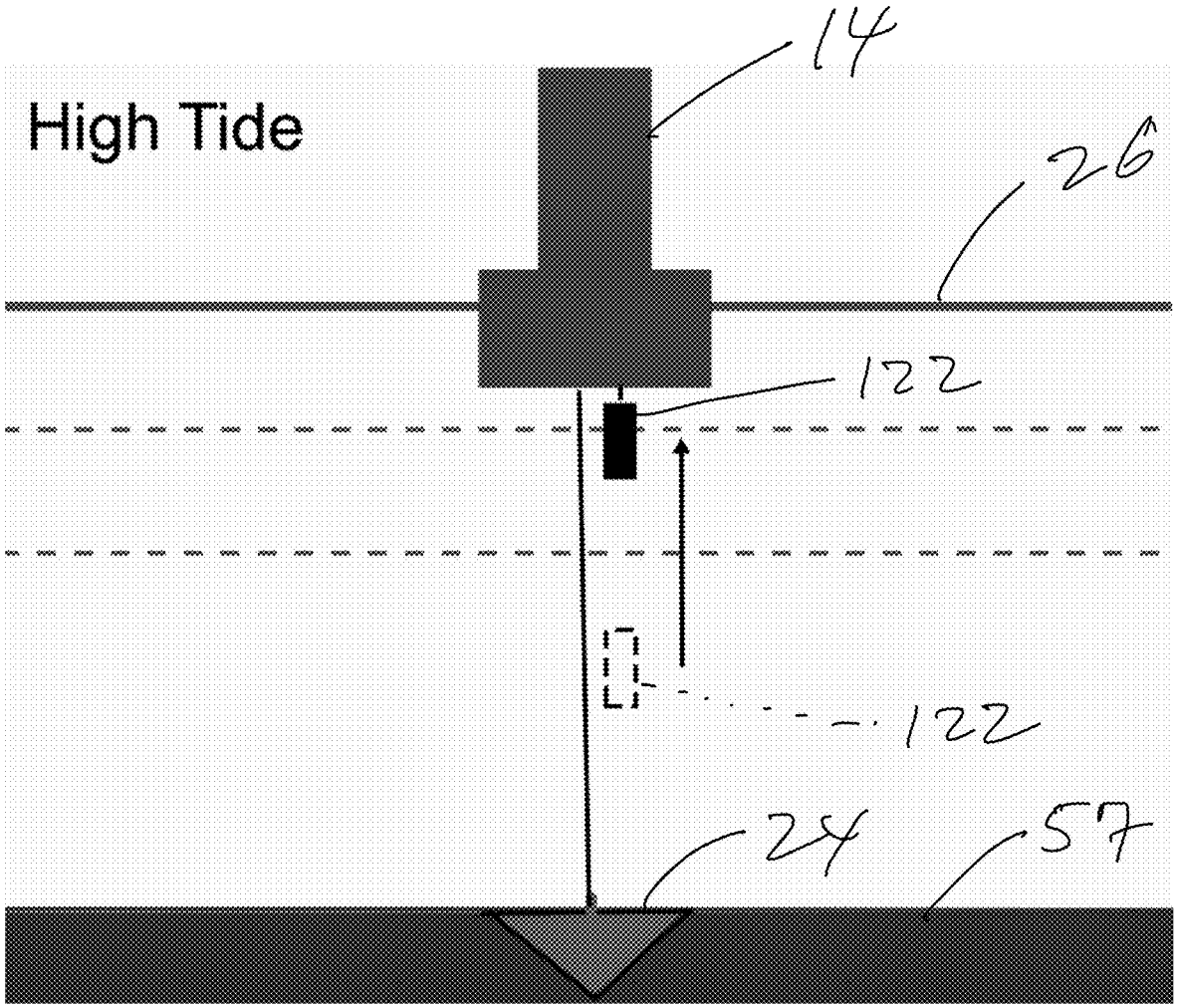
FIG. 13 shows the invention in use during high tide using a non-passthrough tension weight.

As the tide and waterline 26 rise, as seen representationally in FIG. 13, the buoyant force created by the float 14 increases. The anchor 24, having significantly more weight than the tension weight 22, 122, maintains its vertical position in the water column 12, namely, at the mudline 57. The buoyant force causes the float 14 to move up with the tide and waterline 26 and away from the anchor 24 as the tether 16 pulls the tension weight 22, 122 upwards and closer to the pulley assembly 20. Nevertheless, the downward gravitational force of the tension weight 22, 122 remains constant and imparts sufficient tension on the tether 16 as to pull the float 14 into a position above the anchor 24 in spite of the change in tide (as well as the wind, waves, and current).

Figure 14:
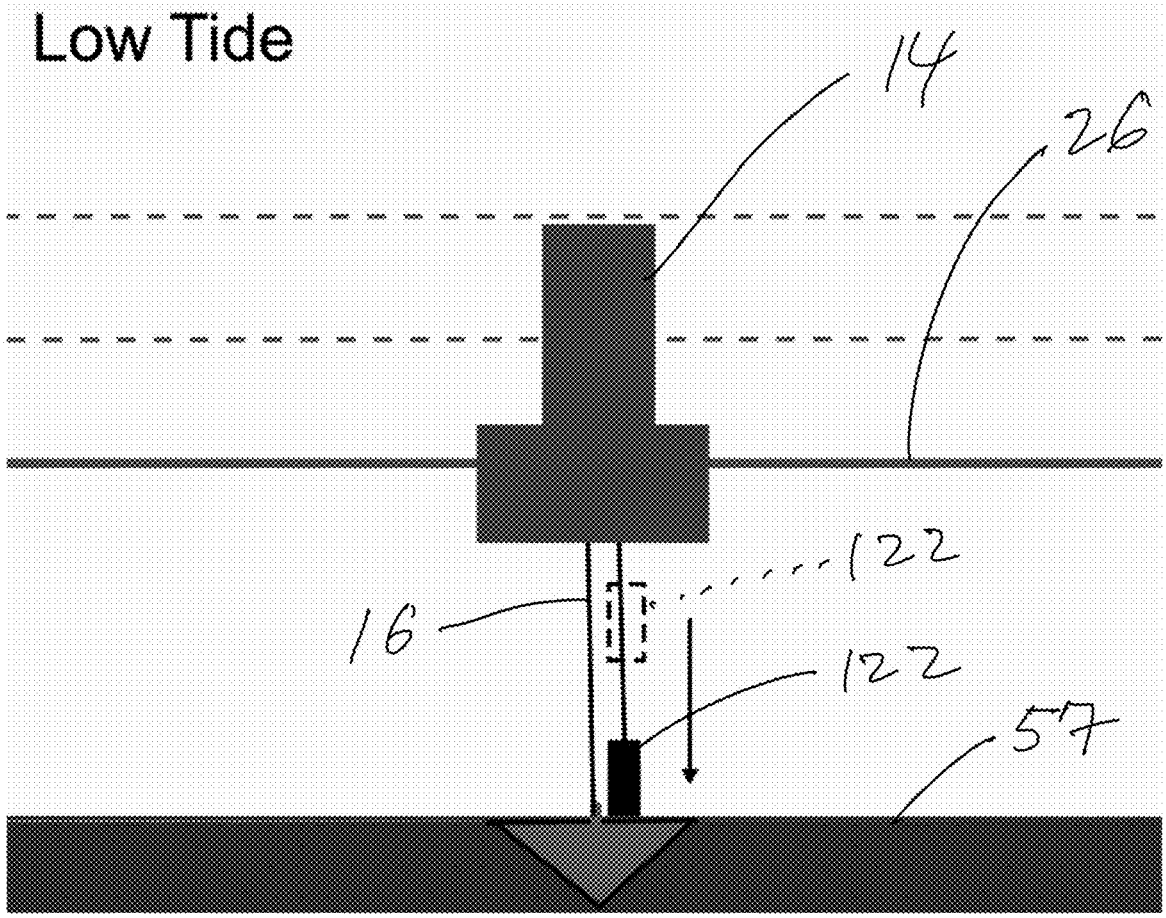
FIG. 14 shows the invention in use during low tide using a non-passthrough tension weight.

As the tide and waterline 26 lower, as representationally shown in FIG. 14, the buoyant force created by the float 14 decreases. The anchor 24 having significantly more weight than the tension weight 22, 122 maintains its vertical position in the water column 12, namely, at the mudline 57. The tension weight 22, 122 is then able to overcome the decreasing buoyant force and is able to travel downward and away from the float 14 as the float 14 moves closer to the anchor 24. Nevertheless, the downward force of the tension weight 22, 122 remains constant and imparts sufficient tension on the tether 16 as to pull the float 14 into a position above the anchor 24 in spite of the change in tide (as well as the wind, waves, and current).

The tether 16 is preferably long enough to accommodate the mean higher high tide at a given location such that the tension weight 22, 122 never comes in contact with the pulley assembly 20 and causes float 14 to submerge or cause the buoyant force of the float 14 to increase to the point at which it dislodges the anchor 24. However, it would preferably not be so long as to allow the tension weight 22, 122 to rest on the top of the anchor 24 at the mudline 57 at any time, even at the mean lower low tide, such that the downward force imparted by the tension weight 22, 122 on the tether 16 never decreases to zero and, thus, becomes incapable of producing sufficient tension on the tether 16 so as to pull the float 14 into a position above the anchor 24 in spite of the change in tide (as well as the wind, waves, and current).

Therefore, the gravity buoy 10 functions in locations where the great diurnal range is greater than the depth of the mean lower low tide as set forth below.

Therefore, four components create forces on the tether 16 at all times: (1) the anchor 24 transmits the force of gravity pulling downwards on the tether 16 between the anchor 24 and the pulley assembly 20 on the bottom of the float 14; (2) the inline weight 54 transmits the force of gravity pulling downwards on the tether 16 between the anchor 24 and the pulley assembly 20 on the bottom of the float 14; (3) the float 14 transmits a buoyant force pulling upwards on the tether 16 between the pulley assembly 20 and the anchor 24, and between the pulley assembly 20 and the tension weight 22, 122; and (4) the tension weight 22, 122 transmits the force of gravity pulling downwards on the tether 16 between the tension weight 22, 122 and the pulley assembly 20. All other forces being equal, these four forces are reasonably constant and their sum results in an equilibrium such that the distance between the float 14 and the anchor 24 is constant at a given moment in time, as shown representationally in FIG. 10.

As the tide and waterline 26 rise, the buoyant force created by the float 14 increases. The anchor 24 and inline weight 54, having significantly more weight than the tension weight 22, 122, maintain their vertical positions in the water column 12, this buoyant force causes the tether 16 to pull the tension weight 22, 122 upwards and closer to the pulley assembly 20 as the float 14 moves up with the tide and away from the anchor 24. Nevertheless, the downward force of the tension weight 22, 122 remains constant and imparts sufficient tension on the tether 16 as to pull the float 14 into a position above the anchor 24 in spite of the change in tide (as well as the wind, waves, and current). This action is not significantly different from that shown in FIG. 13.

Figure 15:
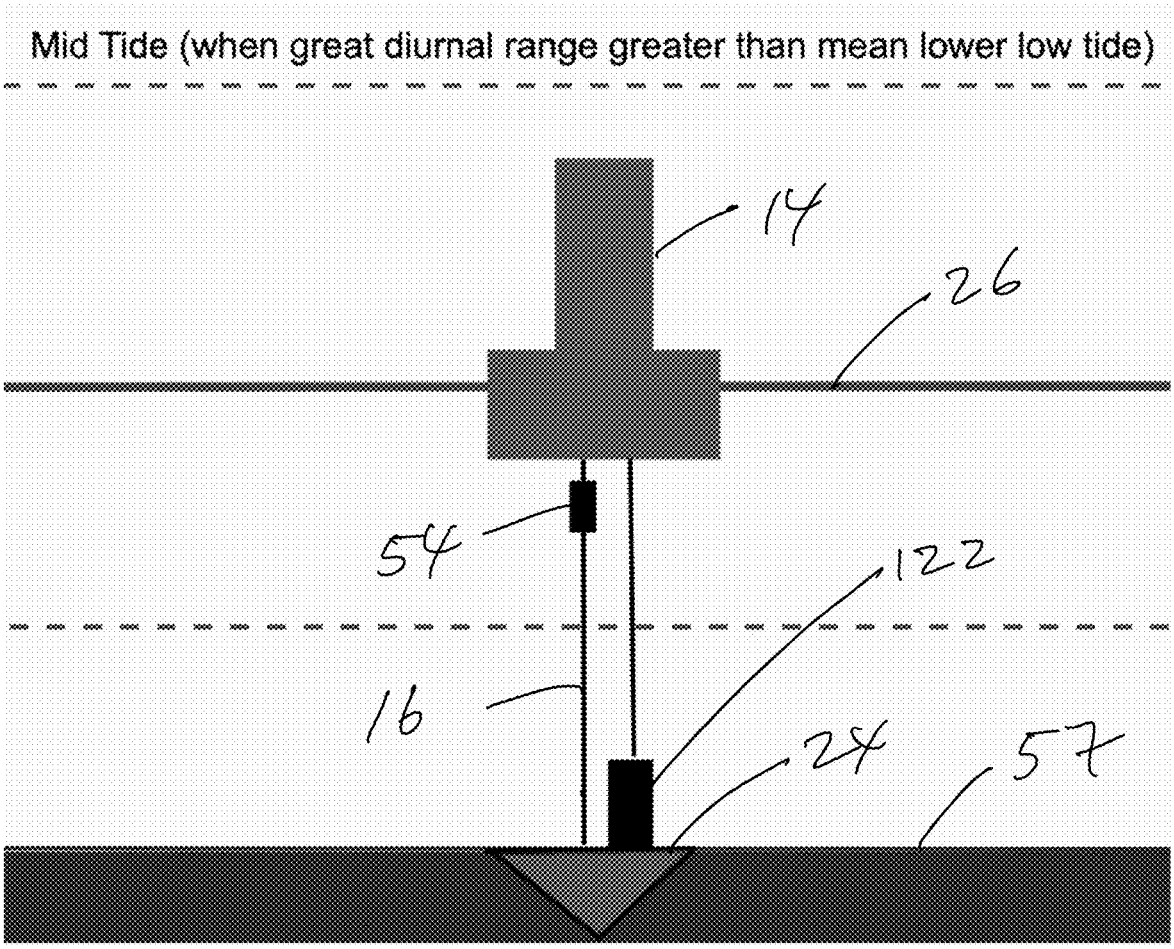
FIG. 15 shows the invention in use during mid tide when the great diurnal range is greater than the mean lower tide using a non-passthrough tension weight and an inline weight.

As the tide and waterline 26 lower to a mid-tide level, as in FIG. 15, the buoyant force created by the float 14 decreases. The anchor 24 and inline weight 54, having significantly more weight than the tension weight 22, 122, maintain their vertical positions in the water column 12. The tension weight 22, 122 is then able to overcome the decreasing buoyant force and is able to travel downward and away from the float 14. A separate section of the tether is connected to the inline weight 54 from the anchor 24. The tether 16 is straight/taught on the anchor side of the tether **16*b* because the tension weight 22, 122 is sufficiently heavier than the inline weight 54**.

Figure 16:
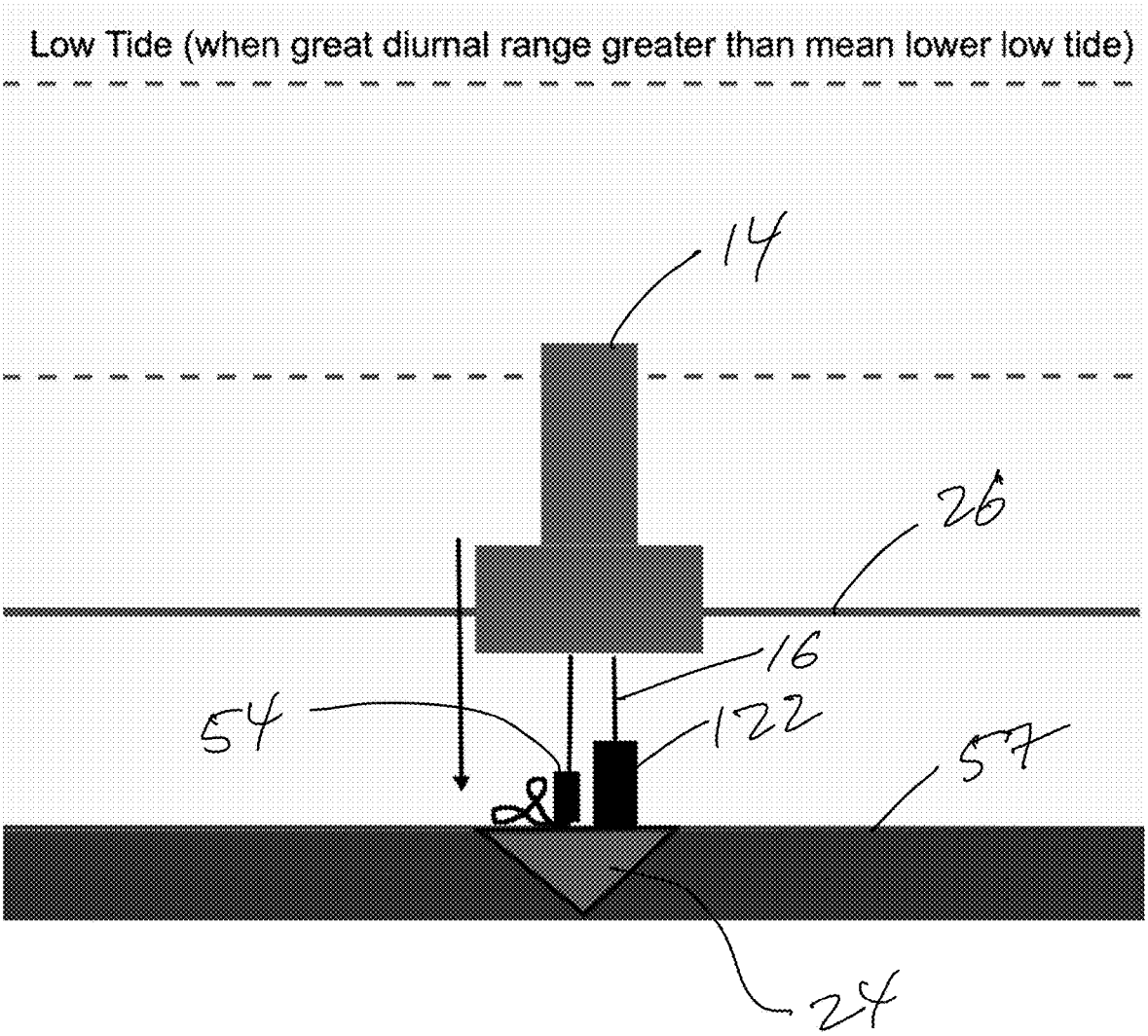
FIG. 16 shows the invention in use during low tide when the great diurnal range is greater than the mean lower tide using a non-passthrough tension weight and an inline weight.
Figure 17:
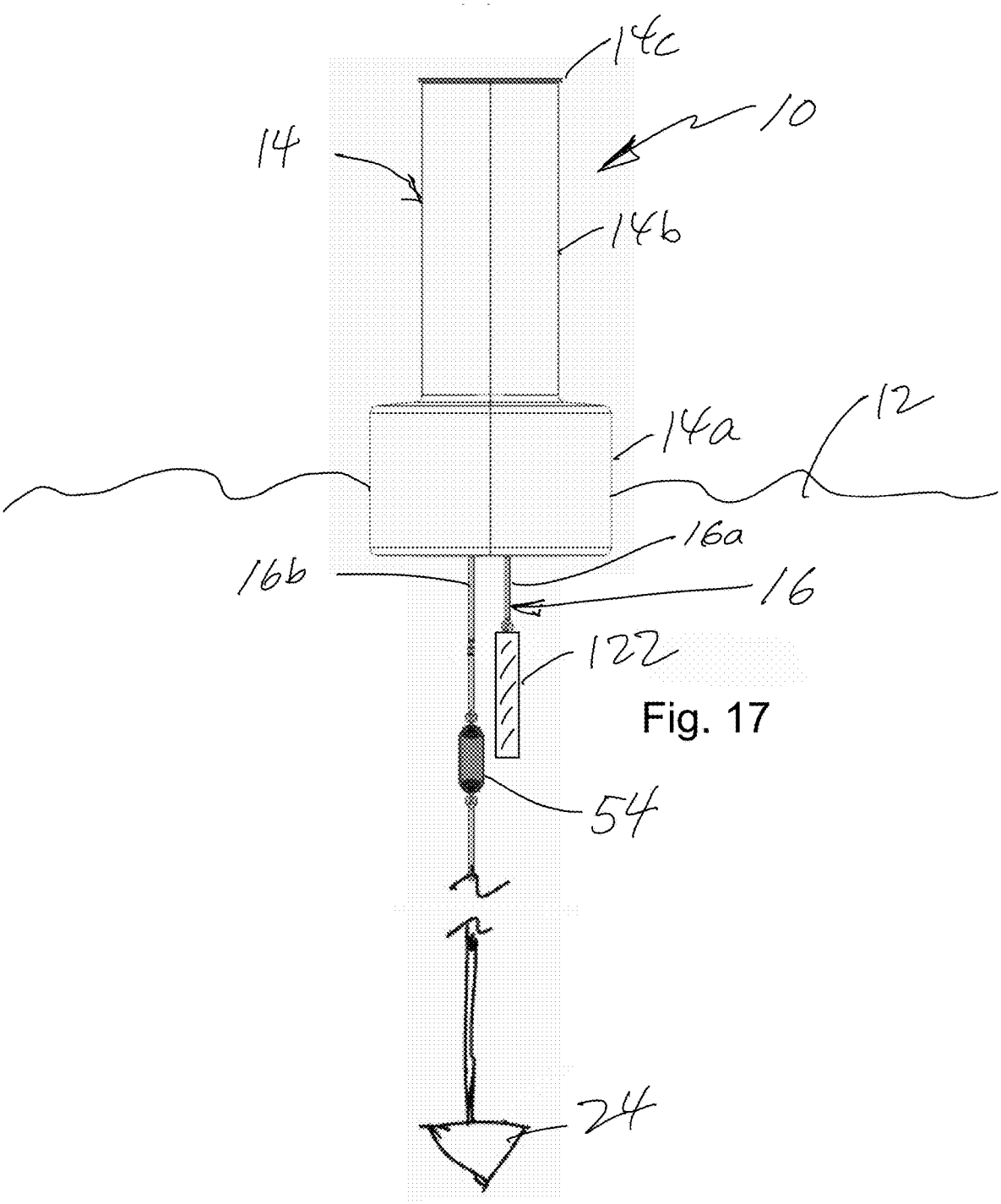
FIG. 17 shows the invention with a non-passthrough cylindrical counterweight and an inline weight.

Eventually, as the tide and waterline 26 continue to lower, the tension weight 22, 122 travels down until the bottom of the tension weight 22, 122 comes to rest on the top surface of the anchor 24, as seen in FIG. 16.

At this point, as in FIG. 16, the anchor 24 is no longer transmitting the force of gravity to the tether 16 because the tension weight 22, 122 is no longer suspended in the water column 12. Instead, as the tide and waterline 26 lowers further due to the fact that the great diurnal range is greater than the mean lower low tide, the downward force of the inline weight 54 imparts sufficient tension on that section of the tether 16 that passes through the pulley assembly 20 and connects to the tension weight 22, 122 so as to continue to pull the float 14 into a position above the anchor 24 in spite of the change in tide (as well as the wind, waves, and current), as shown representationally in FIG. 16. The lower section of the tether 16 that connects the inline weight 54 to the anchor 24 begins to lower and becomes slack, as shown in FIG. 16. The inline weight 54 remains in suspension, continuing to create tension on the tether 16. Thus, the inline weight 54 lowers until it is in contact with the top of the anchor 24 at the mudline 57 and then is no longer capable of imparting tension on the tether 16.

The float 14 can be made of HDPE, for example. The float 14 is preferably manufactured through the rotomolding process, which would require the construction of aluminum molds, vertically oriented with a pressure relief port at the top center of the float 14. As there are various chemical compositions of HDPE, one that shows effective resistance to marine fouling and suitability for rotomolding would be selected. The tension weight 22, 122 is preferably cast out of steel. It is preferably galvanized to prevent corrosion. The inline weight 54 is preferably cast out of steel. It is preferably galvanized to prevent corrosion. The pulley wheel 30 is preferably manufactured from a 3.25 inch round of HDPE. Using a saw to cut a disc from the round approximately 0.625 inches in height. A hole is drilled into the center of the disc from top to bottom. The shaft 32 is preferably manufactured from a 0.50 inch rod of HDPE, to be determined after testing. A saw may be used to cut a cylinder from the rod approximately 1.625 inches in height.

The shaft 32 is inserted through the pulley wheel 30 and then mounted into the recess 42 in plug 18. The shaft 32 can be secured in place into the pulley wheel 30 by compression fit, forming the pulley assembly 20, causing the shaft 32 and pulley wheel to rotate together inside the recess 42 in the plug 18. Alternatively, the shaft 32 may be loosely fit in the plug 18 causing the pulley wheel 30 to rotate about the shaft 32. Alternatively, the pulley assembly 20 may be entirely machined from a single round of HDPE using a lathe to form a single piece.

The plug 18 would preferably be manufactured through the injection molding process, which would require the appropriate molds. As there are various chemical compositions of HDPE, one that shows effective resistance to marine fouling and suitability for injection molding would be selected.

It would be appreciated by those skilled in the art that various changes and modifications can be made to the illustrated embodiments without departing from the spirit of the present invention. All such modifications and changes are intended to be covered by the appended claims.

What is claimed is:

1. A gravity buoy in water, comprising:

a float having a bottom;

a pulley assembly connected to the bottom of the float;

a tension weight;

an anchor;

a tether having a first end and a second end; the tether being routed through the pulley assembly with the first end of the tether being connected to the anchor and the second end of the tether being connected to the tension weight;

wherein the float includes a seat in the bottom thereof; a plug carrying the pulley assembly; the plug residing in the seat;

wherein, during changes in levels of the water, tension is maintained on the tether by the tension weight to maintain the float's location above the anchor.

2. The gravity buoy of claim 1, wherein the plug threadably resides in the seat.

3. The gravity buoy of claim 1, wherein the plug releasably resides in the seat.

4. The gravity buoy of claim 1, wherein the seat of the float includes at least one protrusion and the plug includes at least one spring-biased arm;

wherein at least one spring-biased arm respectively releasably engages with at least one protrusion of the seat of the float.

5. The gravity buoy of claim 1, wherein the pulley assembly includes a wheel rotationally mounted on a spindle.

6. The gravity buoy of claim 1, wherein the plug includes a housing with a recess; the pulley assembly residing in the recess.

7. The gravity buoy of claim 1, further comprising:

an inline weight interconnected to the tether on an anchor side of the pulley assembly.

8. The gravity buoy of claim 1, wherein the tension weight is cylindrical and suspended from the tether.

9. The gravity buoy of claim 1, wherein the tension weight includes a pass-through aperture; the tether running through the pass-through aperture of the tension weight.

* * * * *